United States Patent [19]

Szablowski

[11] 4,209,220

[45] Jun. 24, 1980

[54] WIPE-IN TERMINAL FOR PRINTED CIRCUITS

[75] Inventor: Teofil Szablowski, Warren, Ohio

[73] Assignee: General Motors Corporation, Detroit, Mich.

[21] Appl. No.: 912,324

[22] Filed: Jun. 5, 1978

[51] Int. Cl.[2] ..... H01R 9/08

[52] U.S. Cl. ..... 339/217 S; 339/17 F; 339/258 R

[58] Field of Search ..... 339/17 F, 176 MF, 176 MP, 339/217 R, 217 S, 258 RC

[56] References Cited

U.S. PATENT DOCUMENTS

| | | | |
|---|---|---|---|
| 3,289,146 | 11/1966 | Tuchel | 339/176 MP |
| 3,365,694 | 1/1968 | Parker | 339/17 F |
| 3,977,757 | 8/1976 | Yurtin | 339/217 S |

*Primary Examiner*—Roy Lake
*Assistant Examiner*—Eugene F. Desmond
*Attorney, Agent, or Firm*—F. J. Fodale

[57] ABSTRACT

Two types of wipe-in terminals for printed circuits feature a resilient inclined tongue which is integrally attached to a support portion of the terminal by a small radius bend. A second V-shaped bend in the tongue engages the support to serve as a pivot which isolates the small radius bend when the rearward portion of the tongue is depressed.

1 Claim, 6 Drawing Figures

WIPE-IN TERMINAL FOR PRINTED CIRCUITS

This invention relates generally to wipe-in terminals for printed circuits and more particularly to wipe-in terminals characterized by a resilient inclined tongue integrally connected to a support portion of the terminal in cantilevered fashion such as disclosed in U.S. Pat. No. 3,977,757 granted Aug. 31, 1976 to John A. Yurtin for a "Wipe-In Female Terminal for Printed Circuits".

As disclosed in the Yurtin patent, these wipe-in terminals establish electrical contact with a printed circuit via the resilient inclined tongue which wipes an overhanging flexible conductor strip of the printed circuit over the edge of a support member as the terminal is assembled to the support member. During this assembly process, the inclined tongue is depressed toward the support portion of the terminal and the quality of the electrical connection after assembly depends upon the spring back characteristics of the inclined tongue.

The tongue depression capability of the Yurtin terminal is limited by the small radius bend connecting the inclined tongue to the support portion of the terminal. A very high depression of the Yurtin tongue during the assembly process results in a permanent set in the small radius bend which inhibits spring back and a good electrical connection.

The object of this invention is to provide an improved tongue for a wipe-in terminal which has higher depression capabilities than the Yurtin tongue.

Another object of the invention is to provide an improved tongue for a wipe-in terminal which has higher spring back characteristics for improving the electrical connection with the wiped-in conductor strip.

Another object of the invention is to provide an improved tongue for a wipe-in terminal in which the small radius bend connecting the tongue to the support portion of the terminal is isolated from the assembly forces and consequently does not affect the performance of the assembled terminal.

Figure 1:
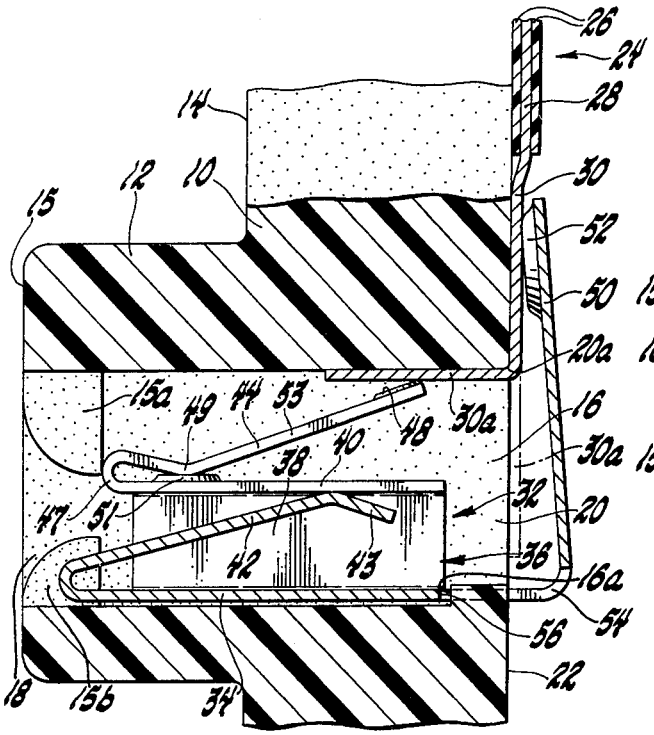
Figure 2:
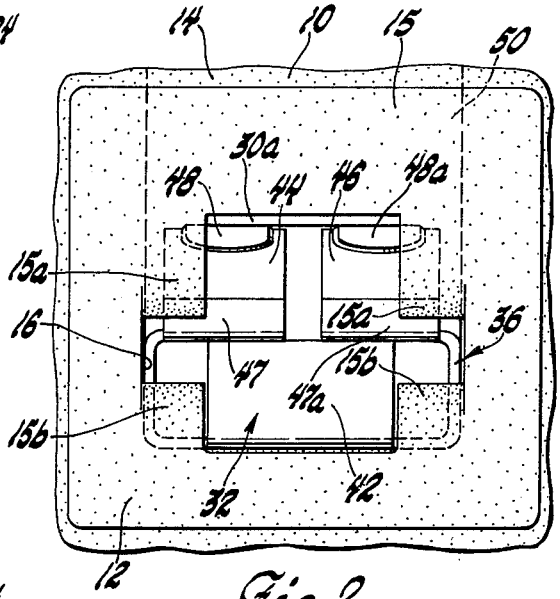
Figure 3:
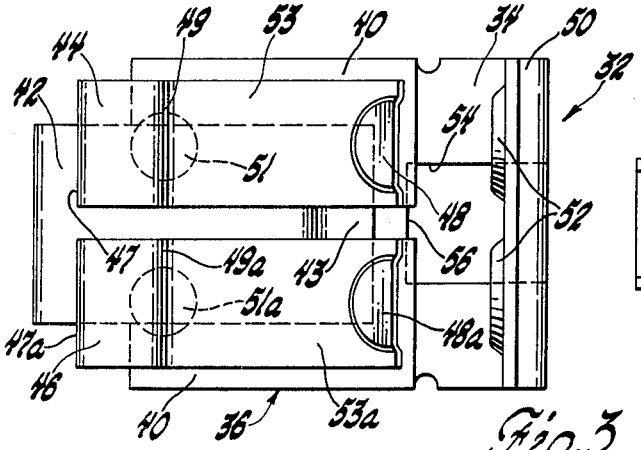
Figure 5:
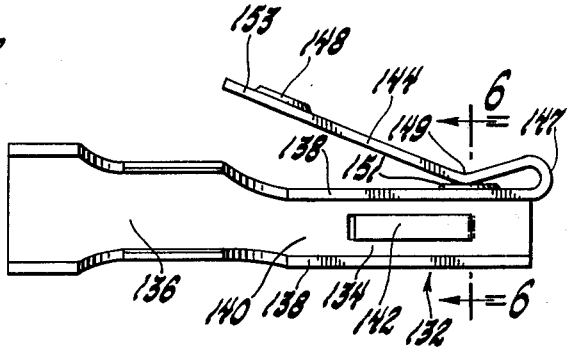
Figure 4:
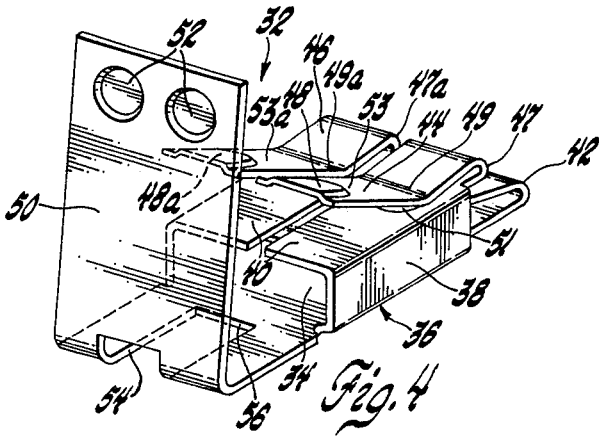
Figure 6:
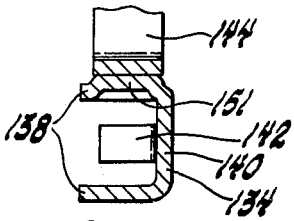

Other objects and features of the invention will become apparent to those skilled in the art as the disclosure is made in the following detailed description of preferred embodiments of the invention as illustrated in the accompanying sheet of drawing in which:

FIG. 1 is a section through a printed circuit assembly having a female wipe-in terminal incorporating a tongue in accordance with this invention, FIG. 2 is a front view of the printed circuit assembly shown in FIG. 1, FIGS. 3 and 4 are top and perspective views respectively of the female wipe-in terminal shown in FIGS. 1 and 2, FIG. 5 is a top plan view of a cable end wipe-in terminal incorporating a tongue in accordance with this invention, and FIG. 6 is an enlarged sectional view taken on line 6—6 of FIG. 5.

Referring now to the drawing and more particularly to FIG. 1, a printed circuit assembly comprising a rigid panel 10 having a boss 12 protruding from the rear surface 14 is shown. An open-ended, generally rectangular cavity 16 extends through the rigid panel 10 from a restricted opening 18 in the rear surface 15 of the boss 12 to an unrestricted opening 20 at the front surface 22 of the panel. The assembly further includes a flexible printed circuit 24 comprising two thin sheets 26 of a generally flexible material, such as a polyester of a few thousandths inch thickness, bonded together with an interposed flat sheet 28 of copper or other suitable conducting material having any desired circuit pattern, but which includes at least one exposed flexible conductor strip 30 for making an electrical connection with a terminal. The flexible printed circuit 24 is carried on the front surface 22 of the rigid panel 10 with the end portion 30*a* of the exposed conductor strip disposed in the cavity 16 and biasingly engaged therein by a female wipe-in terminal 32.

The terminal 32 is insertable into the cavity through the unrestricted opening 20 at the front of the panel and has portions for wiping the end portion 30*a* of the conductor strip 30 (originally overhanging the cavity as shown by the phantom line position) into the cavity when the terminal is inserted into the cavity through the opening 20 and biasingly engaging the wiped-in portion 30*a*. In its assembled position, the terminal 32 also has portions outside of the cavity which contact the conductor strip 30 at locations spaced from the edge 20*a* of the opening 20 over which the conductor strip 30 is wiped-in.

More specifically and referring also to FIGS. 2, 3 and 4, the female wipe-in terminal 32 which is of unitary sheet metal construction comprises a generally planar body portion 34 having an intermediate box-like portion 36. The box-like portion 36 includes side walls 38 contiguous respectively with laterally spaced sides of the body portion 34 which side walls 38 have inturned lateral supports 40 at their free ends. The inturned lateral supports 40 are substantially coplanar and may have a spacing therebetween. A resilient tongue 42 is connected to the forward end of body portion 34 by a reverse bend from whence the tongue 42 extends upwardly and rearwardly into the interior of the box-like portion 36 where it terminates in a downwardly bent lip portion 43. The tongue 42 is for biasing a male terminal received in the box-like portion 36 into engagement with the interior surfaces of the inturned supports 40.

The unique portion of the terminal 32 resides in the resilient inclined wipe-in tongue. This particular terminal has two such tongues 44 and 46 which are connected to the respective forward ends of the inturned supports 40. The tongues 44 and 46 are identical so that only one need be described in detail.

One end of the tongue 44 is integrally connected to the forward end of one of the inturned supports 40 by a small radius reverse bend 47. A second bend 49 intermediate the ends of the tongue 44 engages a raised flat 51 of the support 40 to provide a pivot which substantially isolates the reverse bend 47 when the inclined rearward portion 53 of the tongue 44 is depressed. The second bend is preferably in the shape of a shallow V and placed as near as possible to the reverse bend 47 to maximize the length of the tongue portion 53. The tongue 46 is identical. It has a small radius bend 47*a* at one end and a second intermediate V-shaped bend 49*a* engaging a raised flat 51*a* of its associated support 40 to provide a pivot for the rearward portion 53*a*.

The tongues 44 and 46 may also have raised areas 48 and 48*a* at their free ends for engaging and establishing an electrical connection with the end portion 30*a* of the conductor strip.

The female terminal 32 may further include a transverse portion 50 connected to the rearward end of the body portion 34. The transverse portion 50 extends outwardly of the resilient tongues 44 and 46 and also has a pair of forwardly projecting flat dimples 52 which contact the conductor strip 30 at locations spaced from the edge 20*a* of the opening 20 into the cavity 16.

A longitudinal slot 54 in the body portion 34 extends from the rearward end of the body portion (and through the transverse portion 50) forwardly terminating at a rearwardly facing latch edge 56.

Focusing now on FIGS. 1 and 2, the female terminal 32 is assembled to the rigid panel 10 by inserting the female terminal 32 forward end first into the cavity 16 through the opening 20 at the front surface of the panel. During insertion the inclined rearward portions 53 and 53*a* of the resilient tongues 44 and 46 wipe the overhanging end portion 30*a* of the strip 30 over the edge 20*a* into the cavity 16. During this assembly process the rearward portions 53 and 53*a* are depressed by the reaction of strip end portion 30*a*. The rearward portions 53 and 53*a* are further depressed to accommodate the body portion 34 riding over the central cavity protrusion 16*b* to reach the assembled position shown in FIG. 1 where the stiff latch edge 56 engages the latch shoulder 16*a* to retain the terminal in the cavity.

Over-insertion of the terminal 32 is prevented by the reverse bends 47 and 47*a* engaging two upper corner abutments 15*a* at the cavity opening 18. Two lower corner abutments 15*b* at the cavity opening 18 laterally position the forward end of the terminal. All four abutments have curved surfaces for guiding a male terminal into the box-like portion 36 of the female wipe-in terminal 32.

For a given length and free end height, the tongues 44 and 46 have higher depression capabilities and higher spring back characteristics than the Yurtin tongues. This is due to the intermediate bends 49 and 49*a* which isolate the reverse bends 47 and 47*a* and also foreshorten and consequently stiffen the active length of the tongue during depression.

Referring now to FIGS. 5 and 6 there is shown a cable end wipe-in terminal incorporating a tongue in accordance with this invention. This type terminal may be used for instance in an arrangement such as disclosed in U.S. Pat. No. 3,365,694 granted Jan. 23, 1968 to George W. Parker for "A Connector Means".

The terminal 132 is of unitary sheet metal construction. It comprises a forward channel shaped body portion 134 and a rearward attachment portion 136 which has pairs of core and insulator crimp wings. These wings attach the terminal 132 to a cable end (not shown) in a well-known manner which is illustrated in FIG. 2 of the aforementioned Parker patent.

The forward channel shaped body portion 134 has spaced side walls 138 connected by a web 140. A resilient latch 142 pierced from the web 140 is inclined rearwardly in a position between the side walls 138 to lock the terminal 132 in a connector body (not shown). The side wall 138 which is illustrated as uppermost in FIG. 5 serves as a support for the resilient inclined tongue 144 which is the unique portion of the terminal 132. The tongue 144 is substantially identical in form and function to the tongue 44 described in connection with FIGS. 1–4. The tongue 144 is integrally connected to the side wall 138 by a small radius bend 147. Likewise the tongue 144 has a second intermediate V-shaped bend 149 which engages a raised flat 151 of the side wall 138 to provide a pivot for the rearward portion 153. The tongue 144 may also have a raised area 148 for engaging and establishing an electrical connection with a wipe-in conductor strip. In this particular instance, however, the raised area 148 is spaced from the free end of the rearward tongue portion 153 to permit a prebending or a bowing of the tongue by an associated connector body in the manner shown in the aforementioned Parker patent.

I wish it to be understood that I do not desire to be limited to the exact details of construction shown and described, for obvious modifications will occur to a person skilled in the art.

What is claimed is:

1. In an electrical terminal having a resilient inclined tongue which is integrally connected to a support portion of the terminal in cantilever fashion by a reverse bend at one end of the tongue, said support portion being one side wall of a channel shaped body portion comprising spaced side walls connected by a web whereby the support portion is relatively rigid, the improvement comprising:

said tongue being connected to the one side wall support portion by a reverse bend of small radius and thence having a second bend of shallow V-shape immediately adjacent the reverse bend defining an obtuse angle having an apex, said tongue having a major portion between the apex and an opposite end of the tongue which has a length and outward projection which is substantially greater than the length and outward projection of the portion between the reverse bend and the apex so that the major portion of the tongue constitutes the sole electrical contact portion of the tongue when the tongue wipes a conductive strip against an insulative wall spaced outwardly of the one side wall, said apex of the second bend engaging the one side wall to provide a pivot which substantially isolates the reverse bend when the electrical contact portion of the tongue is depressed toward the one side wall.

* * * * *